United States Patent [19]

Jordan et al.

[11] Patent Number: 4,898,097

[45] Date of Patent: Feb. 6, 1990

[54] MODIFIED PROPELLANT INCREMENTS FOR SHORT RANGE TRAINING ROUND PROPULSION SYSTEM

[75] Inventors: Norman M. Jordan, Wayzata, Minn.; Donald McLaughlin, Joliet, Ill.

[73] Assignee: Honeywell Inc., Minneapolis, Minn.

[21] Appl. No.: 317,889

[22] Filed: Mar. 2, 1989

[51] Int. Cl.[4] ..... C06B 45/00

[52] U.S. Cl. ..... 102/283; 102/282; 102/373; 102/430; 102/431; 102/445; 102/498; 102/529

[58] Field of Search ..... 102/282, 283, 288, 289, 102/291, 293, 430, 431, 432, 373, 444, 445, 447, 395, 498, 700, 529

[56] References Cited

U.S. PATENT DOCUMENTS

| | | | |
|---|---|---|---|
| 695,809 | 3/1902 | Hawk | 102/431 |
| 4,109,579 | 8/1978 | Carter | 102/529 |
| 4,549,487 | 10/1985 | Jensen | 102/498 |
| 4,711,180 | 12/1987 | Smolnik | 102/445 |
| 4,763,577 | 8/1988 | Romer et al. | 102/431 |

*Primary Examiner*—Harold J. Tudor
*Attorney, Agent, or Firm*—Roger W. Jensen

[57] ABSTRACT

A modified propellant increment for the propulsion system of an ammunition round includes a body composed of combustible propellant material and having a hollow interior, and a plurality of holes defined through the body which communicate the exterior of the body with the hollow interior thereof. The hollow interior of the body is empty of any propellant other than the propellant material composing the body. The holes are arranged in first and second arcuate rows on opposite planar end portions of the body and ensure complete combustion of the body upon burning thereof.

16 Claims, 1 Drawing Sheet

MODIFIED PROPELLANT INCREMENTS FOR SHORT RANGE TRAINING ROUND PROPULSION SYSTEM

BACKGROUND OF THE INVENTION

1. Field of the Invention

The present invention generally relates to military training with full and short range rounds of combat ammunition and, more particularly, is concerned with an assembly of modified propellant increments for converting the propulsion system of a training round from full to short range.

2. Description of the Prior Art

The United States military currently stocks rounds of mortar ammunition for both combat and training purposes. The ammunition rounds use an assembly of propellant increments to achieve the required tactical ranges for the combat ammunition as well as the full range training round.

The prior art propellant increment has a hollow body composed of combustible material, such as a nitro cellulose material. The hollow body has a horseshoe-shaped configuration and is filled with an appropriate gun propellant material to achieve the desired firing range.

When the ammunition round is fired, both the combustible hollow increment bodies and the propellant material contained therein are ignited and consumed. Their consumption provides the energy necessary for propulsion of the round to its target.

The military also has a requirement for a short range training round, one having approximately one-tenth the range of the full range round. However, current methods for achieving the shorter range produce radical changes in the tactical configuration of the ammunition. Such changes compromise realism in the training. Therefore, a need exists for a different approach for providing a short range training round without undermining realistic training.

SUMMARY OF THE INVENTION

The present invention provides a modified propellant increment and conversion method designed to satisfy the aforementioned needs. The modified propellant increment of the present invention allow conversion of the propulsion system of a training round from full to short range without any other modification required to the training round. Therefore, the realism of the training is not compromised.

Accordingly, the present invention is directed to a modified propellant increment, comprising: (a) a body composed of a combustible propellant material and having a hollow interior; and (b) means defining a plurality of holes through the hollow body which communicate the exterior of the body with the hollow interior thereof for ensuring complete combustion of the body upon burning thereof. The hollow interior of the body is empty of any propellant other than the propellant material composing the body. The body is semi-annular in shape defining a central mounting cavity.

More particularly, the holes are defined in opposite end portions of the body located on opposite sides of its hollow interior. The holes are arranged in first and second series thereof on the opposite end portions of the body. The holes in each series are spaced apart from one another and of the same size and number.

Further, the present invention is directed to a method of converting an ammunition round from full to short range for military training purposes, comprising the steps of: (a) providing an assembly of short range propellant increments having hollow bodies perforated by a plurality of holes, composed of combustible material, and being empty of any propellant other than the combustible material composing their bodies; and (b) substituting the assembly of short range propellant increments having the empty perforated bodies in place of an assembly of full range propellant increments having imperforate hollow bodies filled with propellant charges separate from the combustible material composing their bodies.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Prior Art Propellant Increments

Figure 1:
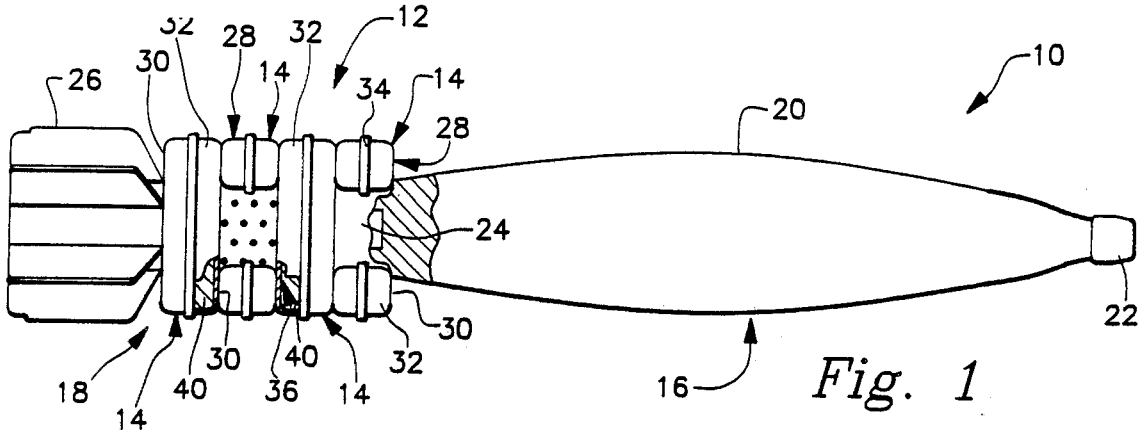
FIG. 1 is a longitudinal axial sectional view, partly in elevation, of a prior art round of combat ammunition incorporating a prior art assembly of propellant increments.

Referring now to the drawings, and in particular to FIG. 1, there is shown a prior art round of mortar ammunition, generally designated by the numeral 10, incorporating a prior art assembly 12 of propellant increments 14. The ammunition round 10 includes a forward portion 16 and rearward portion 18.

The forward portion 16 of the round 10 has a cartridge body 20. The cartridge body 20 is hollow and mounts a fuze assembly 22 at its forward tip end and an explosive charge (not shown) in its interior. The charge is mounted in communication with and ignitable by the fuze assembly 22 upon impact with the target.

The rearward portion 18 of the round 10 has tail boom 24 connected to and extending rearwardly and axially from the rear end of the cartridge body 20. The rearward round portion 18 terminates in a tail fin assembly 26 mounted on the rear portion of the tail boom 24 and spaced from the rear end of the cartridge body 20. The prior art propellant increments 14 in the compact assembly 12 thereof are disposed side-by-side on the tail boom in the space between the tail fin assembly 26 and rear end of the cartridge body 20.

Each prior art propellant increment 14 has a body 28 defined by a pair of generally planar opposite end walls 30 interconnected by a continuous arcuateshaped side wall 32 incorporating a connecting band 34. The end walls 30 and continuous side wall 32 of the body 28 define a hollow interior 36 and are composed of a combustible propellant material, such as a nitro cellulose.

The hollow body 28 thus has a semi-annular, horseshoe-shaped configuration defining a central cavity 38 through which it is mounted to the tail boom 24. The hollow interior 36 of the body 28 is filled with an appropriate gun propellant material 40 to achieve the desired full firing range.

When the ammunition round 10 is fired, both the hollow bodies 28 of the combustible increments 14 and the propellant material 40 contained therein are ignited and consumed. Their consumption provides the energy necessary for propulsion of the round 10 to its target.

Modified Propellant Increments cf Present Invention

Figure 2:
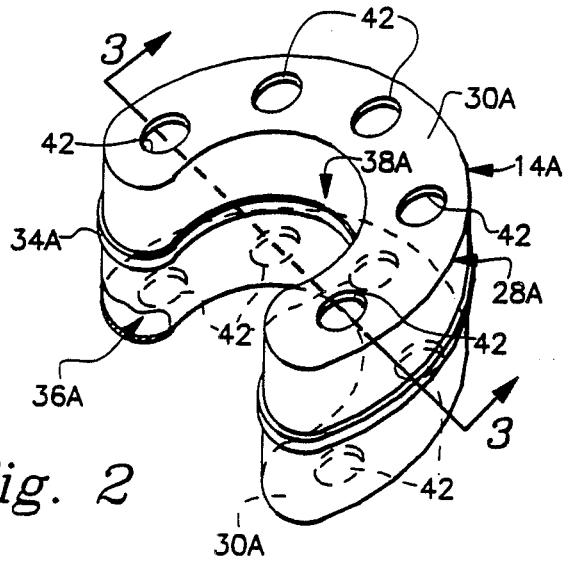
FIG. 2 is a perspective view, with a portion broken away and sectioned, of a modified propellant increment in accordance with the present invention.
Figure 3:
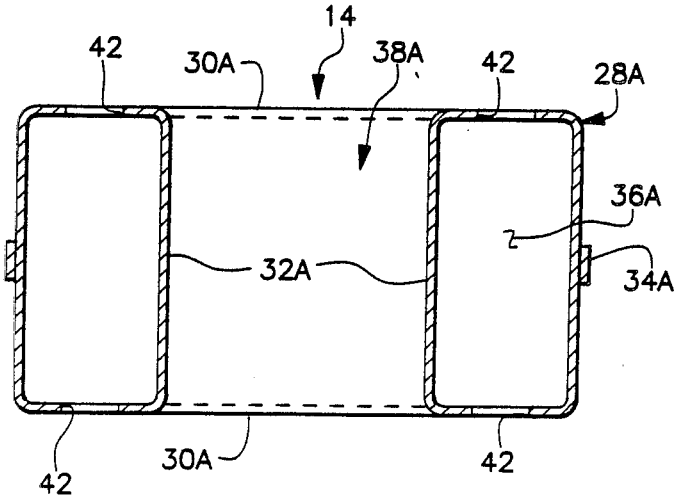
FIG. 3 is an enlarged cross-sectional view taken along line 3—3 of FIG. 2.

Referring now to FIGS. 2 and 3, there is shown a modified propellant increment 14A in accordance with the present invention. The xodified increment 14A allows conversion of the propulsion system of the training round 10 from full to short range without any other modification required to the training round 10. Except for the modifications which will be described hereafter in detail, the makeup of the modified increment 14A is identical to the prior art increment 14. Therefore, the parts of the modified increment 14A corresponding to those in the prior art increment 14 are identified with the same reference numeral followed by the suffix "A".

One modification provided in the increment 14A is that the increment 14A is used with its hollow interior 36A empty of any extra propellant 40 (used in the prior art increment 14) other than the combustible propellant material which composes its hollow body 28A. The other modification is a plurality of holes 42 defined through the hollow body 23A. The holes 42 are arranged in first and second series or arcuate rows thereof. Each row of holes 42 is defined one of the planar end walls 30A of the hollow body 28A located on opposite sides of its hollow interior 36A.

Preferably, the holes 42 are formed by being punched in the end walls 30A. Further, the holes 42 on one end wall 30A are aligned with the holes 42 on the other end wall 30A. Also, the holes 42 in each series are spaced apart from one another and of the sam size and number.

Thus, the holes 42 through the hollow body 28A communicate the exterior of the increment body with the hollow interior 36A thereof. The nitro cellulose combustible propellant material composing the body 28A provides a reduced propellant charge for shorter ranges. The holes 42 ensure complete combustion of the body 28A, eliminating any burning debris from escaping the gun muzzle. The size and number of the holes 42 can be varied to suit the requirements of a particular mortar system. The present invention is applicable to all calibers.

In summary, the present invention provides a technique for adapting a full range round 10 to a short range without making any modification thereto except for modifying its propulsion system. The modification is carried out merely by substituting an assembly of modified short range propellant increments 14A having empty perforated hollow bodies 28A in place of an assembly 12 of prior art full range propellant increments 14 having imperforate hollow bodies 28 filled with propellant charges 40 when short range training is to be undertaken instead of full range training. The result is a short range training round that is the same approximate weight as the tactical round and is fired in exactly the same manner as the tactical round, eliminating any compromise of training.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. A modified propellant increment for an ammunition round, comprising:
   (a) a body composed of a combustible propellant material and having a hollow interior, said body being semi-annular in shape defining a mounting cavity; and
   (b) means defining a plurality of holes through said hollow body which communicate the exterior of said body with said hollow interior thereof for ensuring complete combustion of said body upon burning thereof.

2. The modified increment of claim 1 wherein said hollow interior of said body is empty of any propellant other than said propellant material composing said body.

3. The modified increment of claim 1 wherein said holes are defined in portions of said body located on opposite sides of its hollow interior.

4. The modified increment of claim 3 wherein said holes are arranged in first and second series thereof on said opposite portions of said body.

5. The modified increment of claim 4 wherein said opposite portions of said body are opposite end portions, said first series of holes being defined in one of said end portions and said second series of holes being defined in the other of said end portions and aligned with said first series of holes.

6. The modified increment of claim 4 wherein said holes in each series are spaced apart from one another and of the same size and number.

7. A modified propellant increment for an ammunition round propulsion system, comprising:
   (a) a body composed of a combustible propellant material and having a hollow interior, said hollow interior of said body being empty of any propellant other than said propellant material composing said body, said body being semi-annular in shape and defining a central mounting cavity; and
   (b) means defining a plurality of holes through said hollow body which communicate the exterior of said body with said hollow interior thereof for ensuring complete combustion of said body upon burning thereof, said holes being defined in portions of said body located on opposite sides of its hollow interior.

8. The modified increment of claim 7 wherein said holes are arranged in first and second series thereof on said opposite portions of said body.

9. The modified increment of claim 8 wherein said opposite portions of said body are opposite end portions, said first series of holes being defined in one of said end portions and said second series of holes being defined in the other of said end portions and aligned with said first series of holes.

10. The modified increment of claim 8 wherein said holes in each series are spaced apart from one another and of the same size and number.

11. A method of converting an ammunition round from full to short range for military training purposes, comprising the steps of:

(a) providing an assembly of short range propellant increments having hollow bodies perforated by a plurality of holes, composed of combustible material, and being empty of any propellant other than the combustible material composing their bodies; and (b) substituting the assembly of short range propellant increments having the empty perforated bodies in place of an assembly of full range propellant increments having imperforate hollow bodies filled with propellant charges separate from the combustible material composing their bodies.

12. A modified propellant increment for an ammunition round, comprising:

(a) a body composed of a combustible propellant material and having a pair of substantially planar opposite end walls and a continuous arcuate shaped sidewall interconnecting said end walls and together therewith defining a hollow interior; and (b) means defining a plurality of holes through said opposite end walls of said hollow body which communicate the exterior of said body with said hollow interior thereof for ensuring complete combustion of said body upon burning thereof.

13. The modified increment of claim 12 wherein said hollow interior of said body is empty of any propellant other than said propellant material composing said body.

14. The modified increment of claim 12 wherein said holes are arranged in first and second series thereof in said opposite end walls of said body.

15. The modified increment of claim 14 wherein said first series of holes is defined in one of said end walls and said second series of holes is defined in the other of said end walls and aligned with said first series of holes.

16. The modified increment of claim 14 wherein said holes in each series are spaced apart from one another and of the same size and number.

* * * * *